United States Patent [19]

Church

[11] Patent Number: 4,641,974

[45] Date of Patent: Feb. 10, 1987

[54] AEROSOL CAN AGITATOR

[76] Inventor: John E. Church, 2727 Fontana, Houston, Tex. 77043

[21] Appl. No.: 715,197

[22] Filed: Mar. 22, 1985

[51] Int. Cl.[4] ..... B01F 15/00

[52] U.S. Cl. ..... 366/342; 366/130

[58] Field of Search ..... 366/130, 342, 348, 349; 273/1 GG; 366/241, 242, 261, 325, 326, 327, 330, 602, 605; 206/220; 141/3, 20

[56] References Cited

U.S. PATENT DOCUMENTS

| | | | |
|---|---|---|---|
| 1,353,443 | 9/1920 | Wilson | 366/130 |
| 2,799,485 | 7/1957 | Silverman | 366/326 |
| 3,087,707 | 4/1963 | Moonan | 366/130 |
| 3,734,469 | 5/1973 | Goldstein | 366/327 |
| 4,152,270 | 5/1979 | Cornell | 494/16 |
| 4,193,698 | 3/1980 | Gartner | 366/130 |
| 4,382,685 | 5/1983 | Pearson | 366/241 |
| 4,542,823 | 9/1985 | Frick | 206/220 |

OTHER PUBLICATIONS

Ser. No. 170,320 Filed 2-1-1962 by Moonan.

*Primary Examiner*—Robert W. Jenkins
*Attorney, Agent, or Firm*—Bill B. Berryhill

[57] ABSTRACT

An improved aerosol can agitator is described. An unbalanced, multi-pronged, agitator aids in more complete more thorough mixing of the contents of an aerosol can. Additionally, paddle-like devices on some of the prongs are utilized to increase the surface area to which pigment and other settled contents may adhere. The use of additional surface area to which pigment and other settled contents may temporarily adhere to aids in the mixing of the pigment with the carrier as the agitator is propelled throughout the carrier within the aerosol can. The unbalanced agitator results in a random, unpredictable agitation pattern thus aiding in more thorough mixing of the entire contents of the can.

19 Claims, 5 Drawing Figures

AEROSOL CAN AGITATOR

BACKGROUND OF THE INVENTION

1. Field of the Invention

This invention relates to an agitator for an aerosol can, and more particularly, to a spray paint can agitator.

2. Description of the Prior Art

The agitator in an aerosol can is typically used to mix the contents thereof, particularly in a spray paint can.

In aerosol paint cans, the pigment is mixed with a carrier to permit a uniform covering of the object to be painted. Once the pigment is thoroughly mixed with the carrier, a gas, which pressurizes the spray paint in the can, propels the carrier/pigment mixture out of the can through a spray tip or atomizer and onto the surface to be painted. The uniformity of the mixture and consequently the uniformity of the coating on a surface sprayed may vary if the contents of the can are not thoroughly mixed. Additionally, clogging of the spray tip may be encountered as a consequence of improper mixing of the aerosol can contents.

Prior art aerosol cans contain one of two types of agitators. Premium paint manufacturers use a single spherical agitator, either a steel ball or an industrial grade glass marble. Some premium spray paint manufacturers use a pair of such balls or marbles in an effort to speed up agitation of the contents.

The second type of agitators used in the prior art are foreign objects which have no uniform weight, size, or shape. Typically the agitators which are used by bargain-priced spray paint manufacturers and aerosol manufacturers are rejected rivets which are otherwise unusable. The use of such objects results in poor mixing properties from one application to the next, as well as poor mixing properties from one can to the next. Additionally, a lack of sufficient weight may result in an agitator being unable to break loose from the settled pigment. In the event the agitator is lodged in the pigment the user of the aerosol can must shake the can, to dislodge and mix the contents.

SUMMARY OF THE INVENTION

In accordance with the present invention, an unbalanced, non-spherical, multi-pronged irregular agitator is provided for use in an aerosol can. The mixing action provided by the agitator is random and nonpredictable, and mixing is achieved irrespective of the shaking action applied by the user. A uniform, predictable mixing action applied by the user to an aerosol can will result in a random, unpredictable mixing pattern by the agitator inside the aerosol can and thus achieves a more thorough mixing of the contents.

In one embodiment of the invention, the agitator is structured about two axes, a major and a minor axis. The major axis has a post-like member or bar whose centerline extends along the major axis. The minor axis lies in a plane, which intersects the major axis at a point off center and off balance relative to the post-like member.

Lying in the plane of the minor axis are several prongs, blades or cross bars which extend out radially from the post-like members. The prongs or blades are spaced accurately from one another, and they are preferably tilted relative to the plane of the minor axis. The prongs or blades resemble a series of paddles which serve several functions. The functions include a digging or scooping action to dislodge settled material from the bottom of the can.

They also provide a surface on which the settled material can contact the carrier during a shaking action. They further tend to impart a spinning motion to the overall structure.

The paddle offset permits a greater exposure to the carrier by nature of the different flight pattern traced by a lagging paddle. The lagging paddle thus does not duplicate the same flight pattern as a leading paddle, nor does it duplicate the flight pattern of adjacent paddles.

In accordance with the present invention the multisurface, unbalanced, non-spherical, agitator with a multitude of projections with a greater surface exposure results in a random, unpredictable mixing action and consequently a more thorough mixing of the settled contents of a can with the carrier.

DESCRIPTION OF A PREFERRED EMBODIMENT

It will be appreciated that the present invention can take many forms and embodiments. Some embodiments of the invention are shown and described to give an understanding of the invention. These embodiments are intended to be illustrative, and not limiting of the invention.

A typical prior art agitator consists of a single spherical object, typically a steel ball or an industrial grade glass marble. Some manufacturers of quality products use two such balls or two marbles. Manufacturers of lower quality, lower cost products typically use foreign objects of differing materials, shapes, and weights.

The use of spherical objects, i.e. glass marbles or steel balls results in a predictable, non-random mixing pattern with the exposed surface area limited by the diameter of the ball or the number of balls. Typically, the user of an aerosol can mixes the contents with a wrist action which pivots the spray can through a semi-circular mixing pattern, thus describing a 180-degree arc as the spray can is rotated to mix the contents. This type of action results in a very uniform, very predictable path traced by the agitator. The mixing results are poor. However, the use of a steel ball or glass marble results in very poor mixing even when a violent or irregular mixing pattern is used. It is therefore apparent that the very slick, very uniform surface of a steel ball or glass marble is responsible to a great extent for the poor mixing results.

Some prior art manufacturers have been using rivets as agitators. The use of these objects likewise results in very poor mixing patterns, as there is no uniformity in their material, shape or weight; consequently there is no uniformity in the mixing of the materials to be mixed.

One of the unique and innovative aspects of the present invention is that the settled contents of an aerosol can may be mixed thoroughly even though a uniform, non-random, predictable agitation pattern is employed by the user, since the unbalanced agitator will trace nonpredictable random mixing patterns regardless of the user's shaking motion. The thorough mixing of the contents is likewise aided by the greater surface area achieved by this invention.

Figure 1:
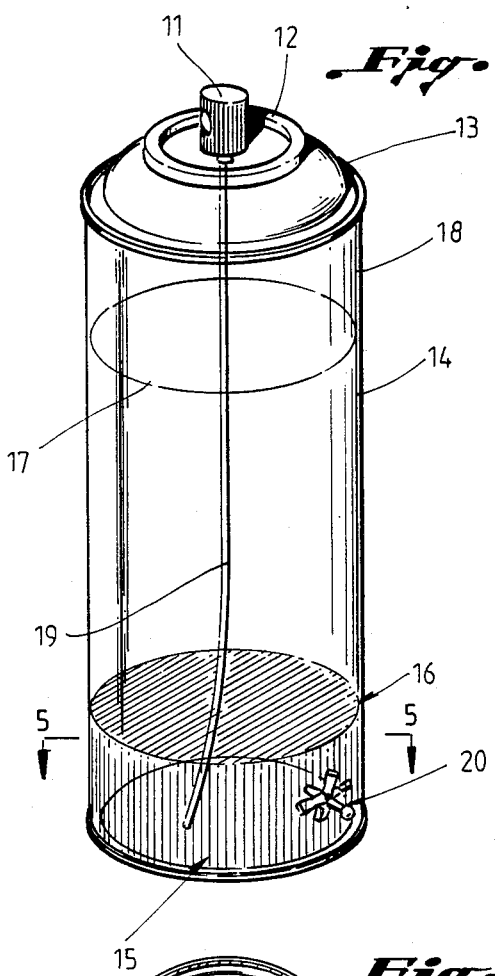
FIG. 1 is an isometric view of an aerosol can with the agitator resting on the bottom of the can.

Referring to FIG. 1, an aerosol can is illustrated with spray nozzle 11, sealing closure 12, can top 13, can sidewalls 14, and domed bottom 15. The pigment or settled contents is denoted by level line 16 and the supernatant carrier is denoted by level line 17. The space 18 is the space occupied by the compressed gas used to propel the carrier/pigment out of the spray nozzle 11.

Tube 19 extends from nozzle 11 in closure 12 to the can bottom 15. Tube 19 carries the carrier/pigment from the bottom up through spray nozzle 11. Also illustrated in FIG. 1 is agitator 20 resting on the domed bottom of the can.

Figure 5:
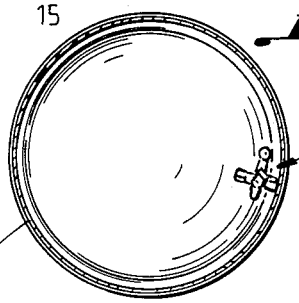
FIG. 5 is a plan view of a can.

FIG. 5 illustrates an agitator paddle in a groove at the bottom of the can. The groove is created by the intersection of the can sidewall with the domed bottom.

Referring to FIG. 1, as received by a paint manufacturer, the closure 12 is not yet part of the can. The manufacturer fills the can, adds an agitator and seals the can with the closure.

Figure 2:
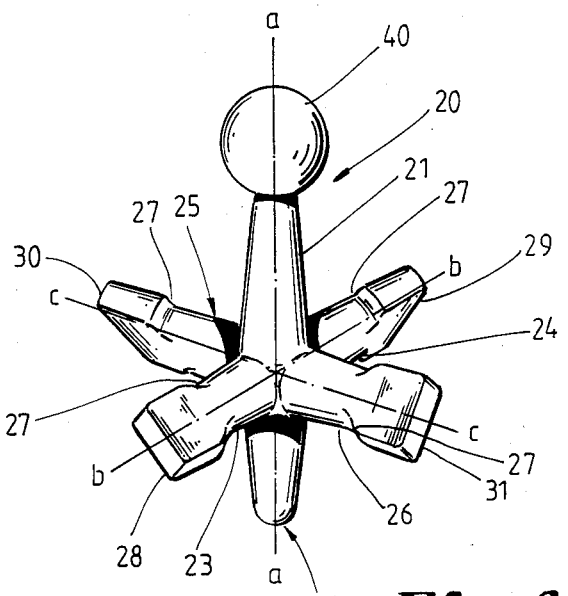
FIG. 2 is an isometric view of one embodiment of an agitator in accordance with the present invention.
Figure 3:
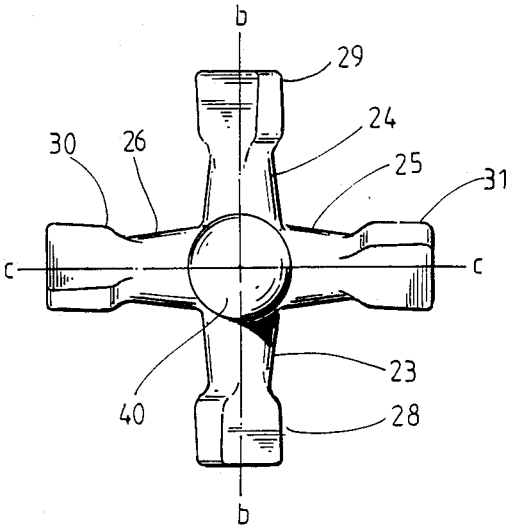
FIG. 3 is a top view of the agitator illustrated in FIG. 2.
Figure 4:
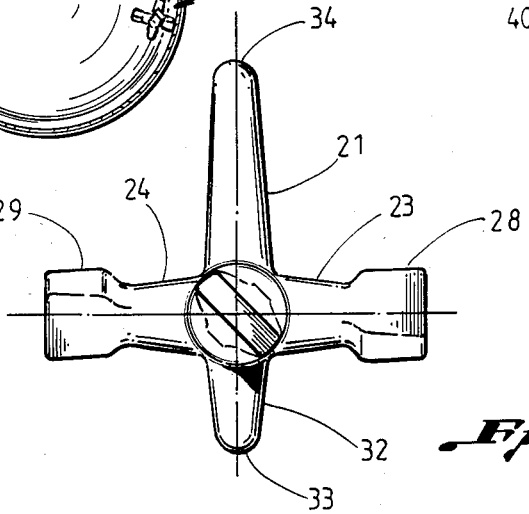
FIG. 4 is an elevational view of another embodiment of an agitator in accordance with the present invention.

Referring to FIG. 2, agitator 20 is shown in an isometric view with three orthogonal axes or centerlines a—a, b—b, and c—c. The axes or centerlines a—a, b—b and c—c do not form a part of the invention, but rather are illustrated in FIGS. 2, 3 and 4 to aid in the description of the invention.

A first component of the agitator 20 is the elongated body or post-like member 21. The longitudinal axis of post 21 coincides with axis or centerline a—a. As shown in FIG. 2, post 21 terminates at one end in a ball or sphere 40 and at its other end in a rounded tip 22. Post 21 tapers in thickness from an intermediate point tqward both ends.

A plane defined by the axes b—b and c—c preferably intersects the axis a—a at a place other than center of post 21. The purpose of this off-center intersection is to achieve an unbalanced agitator. The lack of balance appears to play a significant role in promoting randomness and unpredictability in the mixing motion of the agitator.

A first set of prongs or arms 23 and 24 extend in opposite radial directions from post 21 along axis b—b. Each prong is attached at its inner end to post 21 and it terminates at its outer end in a tilted paddle or blade. Prong 23, for example, terminates in paddle 28 and prong 24 terminated in paddle 29.

Both prongs 23 and 24 preferably taper in thickness to be thinner at the paddles than at the post 21.

A second set of prongs or arms 25 and 26 extend at right angles from post 21 along axis c—c. Prongs 25 and 26, like prongs 23 and 24, are preferably round in cross-section, taper away post 21, and terminate in tilted paddles or blades 30 and 31. As depicted in FIG. 2, paddles 28, 29, 30 and 31 are rotated at about a 45 degree angle from the plane described by axes b—b and c—c.

Paddles 28, 29, 30 and 31 serve various useful purposes, among such purposes, they increase the surface area of the agitator to improve agitation and contact with the settled pigment or other settled material at the bottom of a spray can. The paddles are intentionally not polished or finished, since a coarse surface permits better adhesion of the pigment or sediment to the paddle. As the agitator is propelled through the carrier and gas in the aerosol can, the pigment which has been picked up and has adhered to the paddles is freed and mixed into the carrier. This momentary adhesion to the paddle likewise aids in proper agitation of the contents of the can. The momentary adhesion also results in agitation which is more thorough than that offered by a slick marble or steel ball.

The agitators of the invention do not require paddles to function better than steel balls or marbles. The paddles, however, provide advantages in and of themselves. The paddles need not be flat with square corners as shown but may take other configurations. Curved paddles with rounded corners, for example, would be able to provide the scooping, and adhesive and mixing functions desired. Additionally the paddles may be of any commonly known geometric configuration.

Referring to FIG. 4, an alternate embodiment of the agitator is shown. In this figure axis c—c projects into the paper. The centerline or axis of post 21 coincides with axis a—a. Shown along axis b—b are prongs 23 and 24 and their paddles 28 and 29. Paddles 28 and 29 are offset by 45 degrees from the plane which contains axis b—b and c—c intersects axis a—a. The configuration of prongs 23, 24 and prongs 25, 26 (not shown) as well as paddles 28, 29 and 30, 31 (not shown) are as described for FIGS. 2 and 3.

The alternate embodiment illustrated in FIG. 4 differs from that illustrated in FIGS. 2 and 3 in that no sphere 23 is attached to the top of post 21. Dispensing with the sphere simplifies casting of this nature. The unbalance desired in the agitator is created by extending the length of post 21 above axis b—b and c—c relative to the length below the axes. A short stub below axis b—b and c—c is designated as numeral 32 in FIG. 4. Post 21 in FIG. 4 is rounded at both ends 33 and 34.

The present agitators may be made from a variety of material so long as they are compatible with the substances to be mixed. Brass, steel, metal alloys, ceramics, and the like are satisfactory. They should be substantially greater in density than the substances to be mixed, and they should also be tough enough to withstand the shaking action.

Further modifications and alternative embodiments of the present apparatus and method will be apparent to those skilled in the art having the benefit of this disclosure. Accordingly, this description and the methods described herein are to be construed as illustrative only and for the purpose of teaching those skilled in the art the manner of carrying out the invention. Equivalent components and materials may be substituted for those specifically illustrated and described herein, and certain features of the invention may be utilized independently of the use of other features. All this will be apparent to those who are skilled in the art having the benefit of this disclosure.

What is claimed is:

1. An aerosol can agitator comprising a post whose longitudinal axis lies in a first plane, and a plurality of prongs attached to and extending away from said post such that the longitudinal axes of said prongs lie in a second plane substantially perpendicular to said first plane and to said axis of said post, the length of said post and prongs being less than the diameter of the can in which said agitator is to be used so as to allow totally unpredictable orientation of said agitator in said can.

2. The aerosol can agitator set forth in claim 1 wherein said second plane intersects said axis at a point other than the mid-point of said post.

3. The aerosol can agitator set forth in claim 1 wherein said prongs form an "X" in said second plane.

4. The aerosol can agitator set forth in claim 3 wherein adjacent legs of the "X" are at right angles.

5. The aerosol can agitator set forth in claim 4 wherein each member of the "X" ends in a paddle surface which is at a 45-degree offset from said second plane.

6. The aerosol can agitator set forth in claim 5 wherein said post is unbalanced about the point along its length where it intersects said second plane.

7. An aerosol can agitator comprising a cruciform object with an elongated bar and a plurality of cross-bars whose longitudinal axes lie in a common plane normal to the longitudinal axis of said elongated bar which common plane intersects said elongated bar at a point other than the balance point of said elongated bar, the length of said elongated bar and said cross-bars being less than the diameter of the can in which said agitator is to be used so as to allow totally unpredictable orientation of said agitator in said can.

8. The aerosol can agitator set forth in claim 7 wherein the cross-bars form an "X" in said common plane.

9. The aerosol can agitator set forth in claim 8 wherein each leg of the "X" is at right angles to the next adjacent leg of the "X".

10. The aerosol can agitator set forth in claim 9 wherein each leg of the "X" ends in a flat paddle surface, said flat paddle surface forming a rectangle, at an angle of about 45-degrees with said common plane.

11. The aerosol can agitator set forth in claim 10 wherein said unbalanced elongated bar is created by a spherical body placed at one end of the post.

12. An agitator for use in mixing the contents of an aerosol can be shaking the can comprising:

(a) an elongated post-like member the length of which is less than the diameter of the can in which said agitator is used;

(b) a plurality of prongs, each prong attached at one end to said post-like member and extending laterally from said post-like member, the maximum dimension from the tip of any prong to the tip of any other prong or to the tip of said post-like member being less than said can diameter.

13. The agitator set forth in claim 12 in which said are at least three in number.

14. The agitator set forth in claim 13 in which the free end of each said prong is paddle-shaped.

15. The agitator set forth in claim 14 in which said prongs extend at substantially right angles to said post-like member.

16. The agitator set forth in claim 15 which said prongs are closer to one end of said post-like member than to the other end of said post-like member.

17. The agitator set forth in claim 16 in which said are equi-distant from one end post-like member.

18. The agitator set forth in claim 17 in which each paddle shaped end is tilted relative to its respective prong.

19. The agitator set forth in claim 17 in which the end of said post-like member which is the more remote from said prongs terminates in a ball-like shape.

* * * * *